US010845165B1

(12) United States Patent
Grimmett

(10) Patent No.: US 10,845,165 B1
(45) Date of Patent: Nov. 24, 2020

(54) SELF-DEFENSE BATON WITH AUTOMATED FLARE

(71) Applicant: Charles Grimmett, Matthews, NC (US)

(72) Inventor: Charles Grimmett, Matthews, NC (US)

( * ) Notice: Subject to any disclaimer, the term of this patent is extended or adjusted under 35 U.S.C. 154(b) by 69 days.

(21) Appl. No.: 16/351,811

(22) Filed: Mar. 13, 2019

Related U.S. Application Data

(60) Provisional application No. 62/646,417, filed on Mar. 22, 2018.

(51) Int. Cl.

| | |
|---|---|
| ***F41H 9/02*** | (2006.01) |
| ***F41B 15/02*** | (2006.01) |
| ***F23Q 2/02*** | (2006.01) |
| ***F23Q 2/16*** | (2006.01) |
| ***F23Q 2/00*** | (2006.01) |

(52) U.S. Cl.
CPC ..... *F41H 9/02* (2013.01); *F23Q 2/00* (2013.01); *F23Q 2/02* (2013.01); *F23Q 2/16* (2013.01); *F41B 15/027* (2013.01)

(58) Field of Classification Search
CPC . F41H 9/02; F41B 15/027; F23Q 2/00; F23Q 2/02; F23Q 2/16
See application file for complete search history.

(56) References Cited

U.S. PATENT DOCUMENTS 1,235,465 A * 7/1917 Hage ..... F23Q 25/00 431/144
3,855,710 A 12/1974 Lunden
4,456,255 A 6/1984 Braunhut
5,813,581 A * 9/1998 Hellweg ..... A45F 5/02 224/251
6,099,300 A * 8/2000 Rice ..... F23Q 2/287 431/131
6,711,772 B2 3/2004 Grassi
6,926,519 B1 * 8/2005 Lusson ..... F23Q 2/16 431/254
6,929,466 B1 * 8/2005 Reese ..... F23Q 3/002 431/143
D520,593 S 5/2006 Anderson
7,191,729 B2 3/2007 DeGroat, Jr.
(Continued)

FOREIGN PATENT DOCUMENTS

CA 2872853 4/2016

*Primary Examiner* — Alfred Basichas

(57) ABSTRACT

The self-defense baton with automated flare is used for personal protection. The self-defense baton with automated flare comprises a telescopic structure and a combustion device. The combustion device generates a flame. The combustion device installs in the telescopic structure. The telescopic structure is an extendable structure. The telescopic structure is further defined with a collapsed position, an extended position, a proximal end, and a distal end. The telescopic structure is stored in the collapsed position. In the event of an emergency, the person grasps the telescopic structure and releases a first detent located at the proximal end. The release of the first detent automatically: a) extends the telescopic structure from the collapsed position to the extended position; and, b) ignites the combustion device such that the flame is presented at the distal end of the telescopic structure. A person positions the flame to ward off potential attackers.

18 Claims, 4 Drawing Sheets

(56) References Cited

U.S. PATENT DOCUMENTS

| | | | | |
|---|---|---|---|---|
| 7,421,933 | B1 * | 9/2008 | Pearson | F41H 13/0018<br>361/232 |
| 8,861,169 | B2 | 10/2014 | Bradshaw et al. | |
| 9,192,152 | B1 | 11/2015 | Sparks | |
| 9,693,611 | B2 | 7/2017 | Harris | |
| 9,952,023 | B2 * | 4/2018 | Kuo | F41H 9/10 |
| 2009/0038663 | A1 | 2/2009 | Juslin et al. | |
| 2009/0199884 | A1 | 8/2009 | Lessing | |

* cited by examiner

SELF-DEFENSE BATON WITH AUTOMATED FLARE

CROSS REFERENCES TO RELATED APPLICATIONS

This non-provisional application claims priority under 35 USC 119(e) to United States provisional application U.S. 62/646,417 filed on Mar. 22, 2018 by the inventor, Charles Grimmett.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of mechanical engineering including weapons, more specifically, a hand-held self-defense device that generates a flame.

SUMMARY OF INVENTION

The self-defense baton with automated flare is used for personal protection by a person. The self-defense baton with automated flare comprises a telescopic structure and a combustion device. The combustion device generates a flame. The combustion device installs in the telescopic structure. The telescopic structure is an extendable structure. The telescopic structure is further defined with a collapsed position, an extended position, a proximal end, and a distal end. The telescopic structure is stored in the collapsed position. In the event of an emergency, the person grasps the telescopic structure and releases a first detent located at the proximal end. The release of the first detent automatically: a) extends the telescopic structure from the collapsed position to the extended position; and, b) ignites the combustion device such that the flame is presented at the distal end of the telescopic structure. The person positions the flame to ward off potential attackers.

These together with additional objects, features and advantages of the self-defense baton with automated flare will be readily apparent to those of ordinary skill in the art upon reading the following detailed description of the presently preferred, but nonetheless illustrative, embodiments when taken in conjunction with the accompanying drawings.

In this respect, before explaining the current embodiments of the self-defense baton with automated flare in detail, it is to be understood that the self-defense baton with automated flare is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the self-defense baton with automated flare.

It is therefore important that the claims be regarded as including such equivalent construction insofar as they do not depart from the spirit and scope of the self-defense baton with automated flare. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
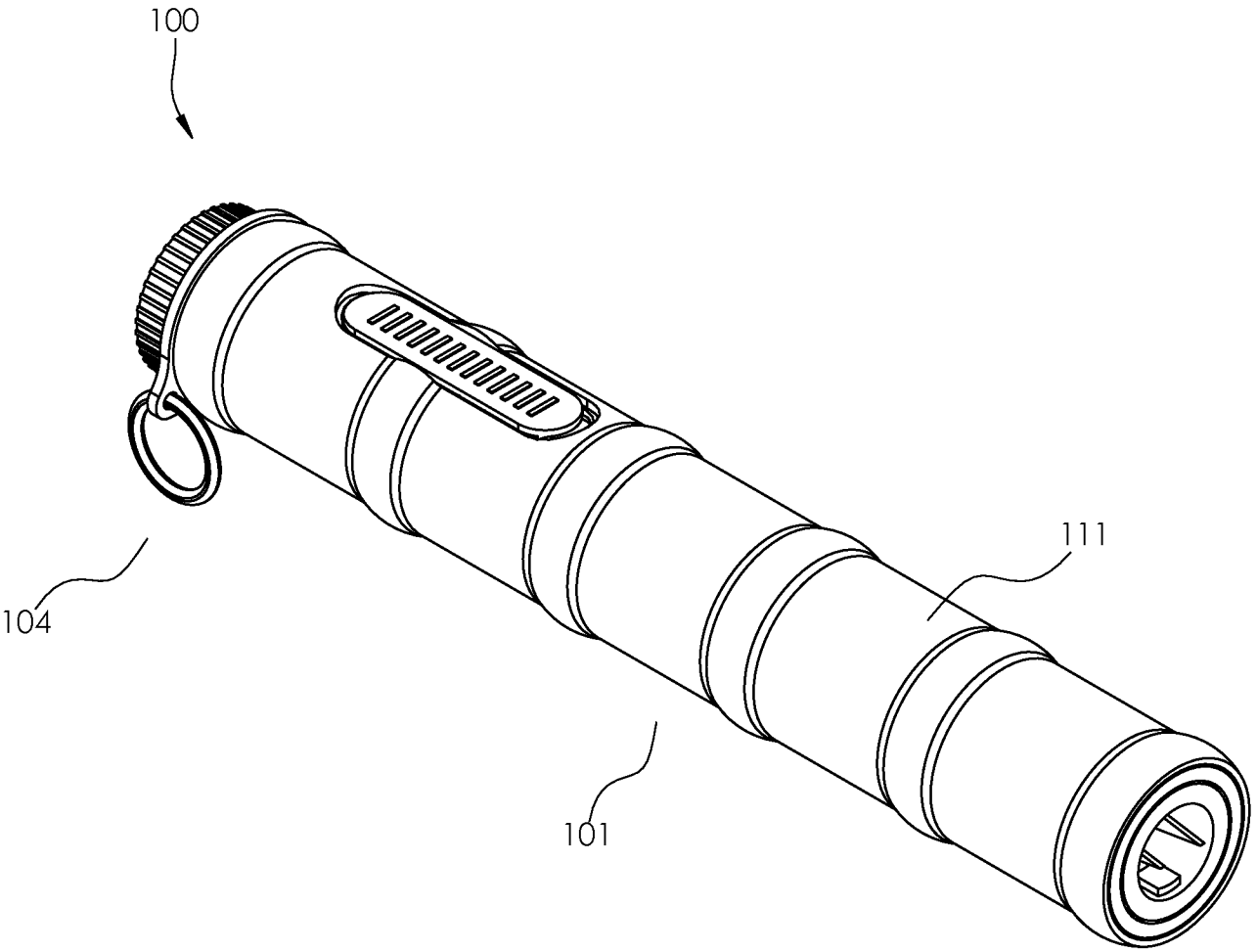
FIG. 1 is a perspective collapsed view of an embodiment of the disclosure.
Figure 2:
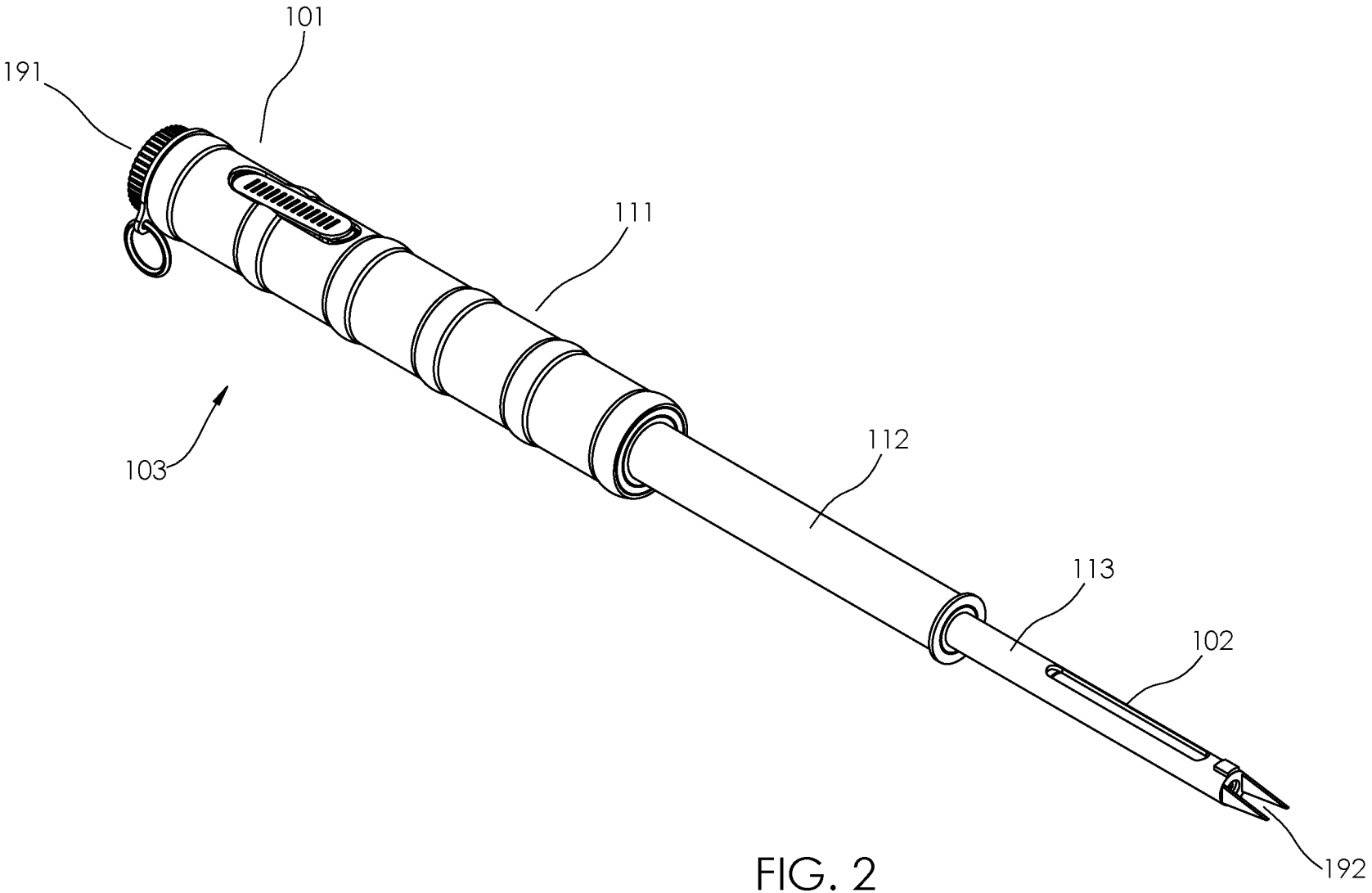
FIG. 2 is a perspective extended view of an embodiment of the disclosure.
Figure 3:
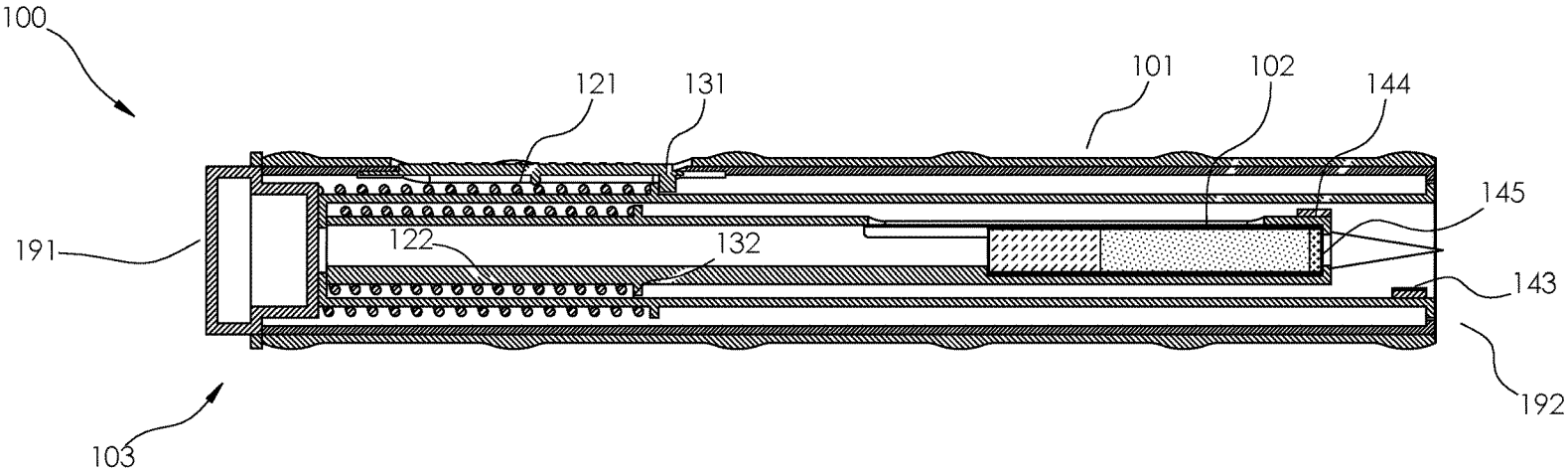
FIG. 3 is a cross-sectional collapsed view of an embodiment of the disclosure.
Figure 4:
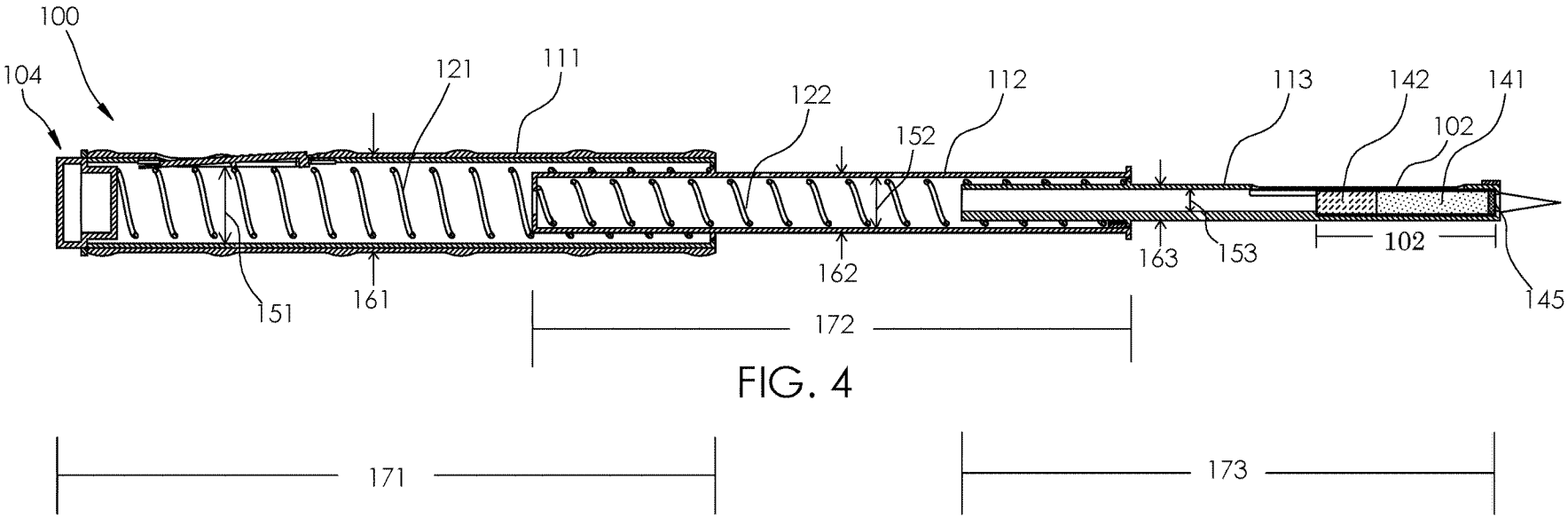
FIG. 4 is a cross-sectional extended view of an embodiment of the disclosure.
Figure 5:
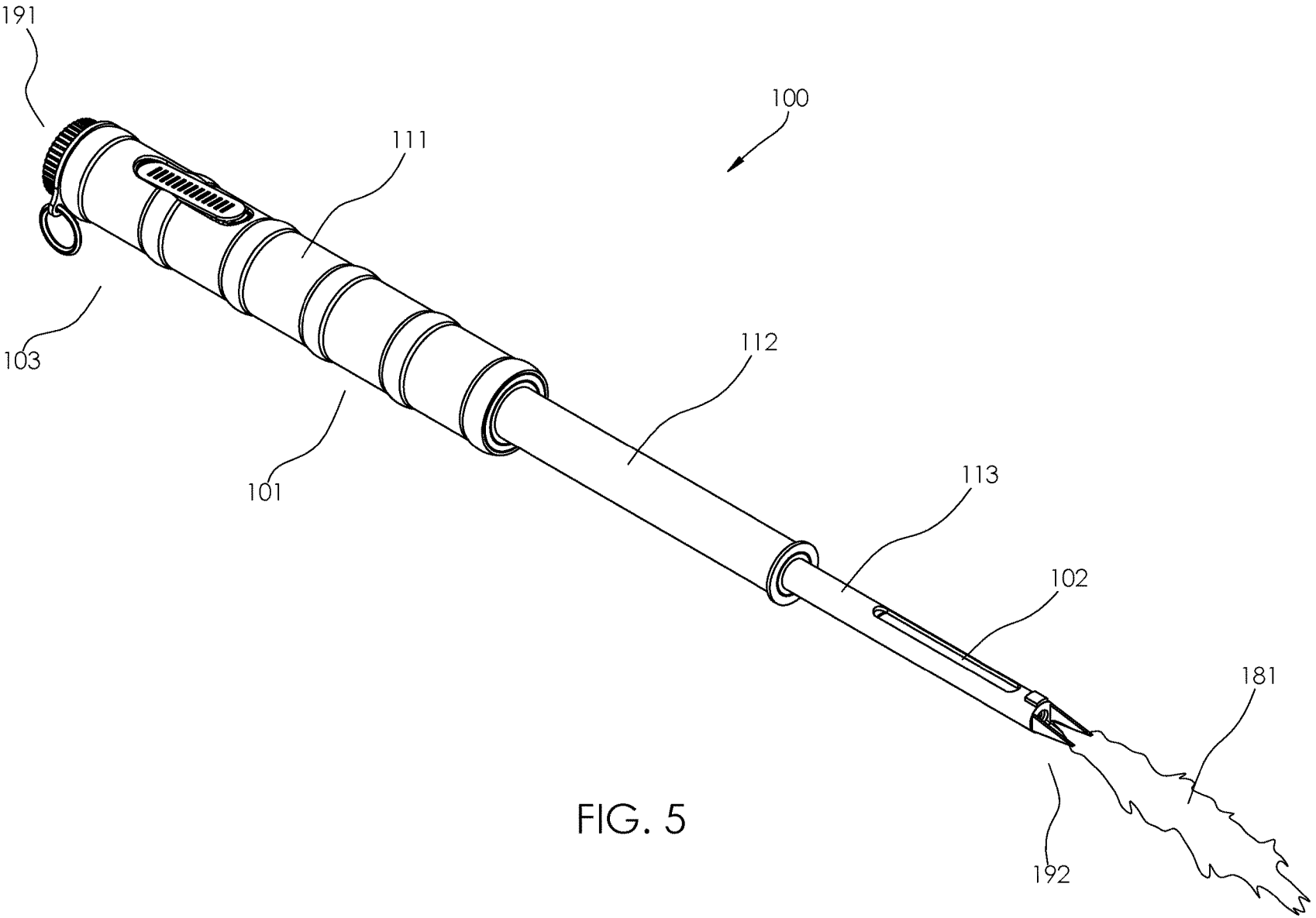
FIG. 5 is an in-use view of an embodiment of the disclosure.

Detailed reference will now be made to one or more potential embodiments of the disclosure, which are illustrated in FIGS. 1 through 2.

The self-defense baton with automated flare 100 (hereinafter invention) is used for personal protection by a person. The invention 100 comprises a telescopic structure 101 and a combustion device 102. The combustion device 102 generates a flame 181. The combustion device 102 installs in the telescopic structure 101. The telescopic structure 101 is an extendable structure. The telescopic structure 101 is further defined with a collapsed position 103, an extended position 104, a proximal end 191, and a distal end 192. The telescopic structure 101 is stored in the collapsed position 103. In the event of an emergency, the person grasps the telescopic structure 101 and releases a first detent located at the proximal end 191. The release of the first detent automatically: a) extends the telescopic structure 101 from the collapsed position 103 to the extended position 104; and, b) ignites the combustion device 102 such that the flame 181 is presented at the distal end 192 of the telescopic structure 101. The person positions the flame 181 to ward off potential attackers.

The telescopic structure 101 is an extension structure. The telescopic structure 101 separates the person using the invention 100 from the flame 181 generated by the combustion device 102. The telescopic structure 101 comprises an outer tube 111, an intermediate tube 112, an inner tube 113, a first helical spring 121, a second helical spring 122, a first detent 131, and a second detent 132. The outer tube 111 is further defined with a first inner diameter 151, a first outer diameter 161, and an outer tube span 171. The intermediate tube 112 is further defined with a second inner diameter 152, a second outer diameter 162, and an intermediate tube span 172. The inner tube 113 is further defined with a third inner diameter 153, a third outer diameter 163, and an inner tube span 173.

The telescopic structure 101 is further defined with a collapsed position 103, an extended position 104, a proximal end 191, and a distal end 192. The telescopic structure 101 is stored the collapsed position 103. The collapsed position 103 is the position of the telescopic structure 101 that has the minimum span. The extended position 104 is the position of the telescopic structure 101 that has the maximum span.

The telescopic structure 101 is an automated structure. When the telescopic structure 101 is released, the telescopic structure 101: a) automatically extends to its extended position 104; and, b) ignites the combustion device 102 to generate the flame 181.

The outer tube 111 is a capped tube. The outer tube 111 forms the outer shell of the telescopic structure 101 when the telescopic structure 101 is in a collapsed position 103. The capped end of the outer tube 111 forms the proximal end 191 of the telescopic structure 101. The outer tube 111 forms the handle of the invention 100.

The intermediate tube 112 is a capped tube. The intermediate tube 112 forms an intermediate structure of the telescopic structure 101 between the outer tube 111 and the inner tube 113. The intermediate tube 112 is an extension structure that separates the distance between the outer tube 111 and the inner tube 113 when the telescopic structure 101 is in the extended position 104. The second outer diameter 162 of the intermediate tube 112 is lesser than the first inner diameter 151 of the outer tube 111 such that the intermediate tube 112 inserts into the intermediate tube 112 in a telescopic fashion. The intermediate tube span 172 of the intermediate tube 112 is lesser than or equal to the outer tube span 171 of the outer tube 111 such that the intermediate tube 112 is fully contained within the outer tube 111 when the telescopic structure 101 is in the collapsed position 103.

The inner tube 113 is a capped tube. The inner tube 113 contains the combustion device 102. The open end of the inner tube 113 forms the distal end 192 of the telescopic structure 101. The third outer diameter 163 of the inner tube 113 is lesser than the second inner diameter 152 of the intermediate tube 112 such that the inner tube 113 inserts into the intermediate tube 112 in a telescopic fashion. The inner tube span 173 of the inner tube 113 is lesser than or equal to the intermediate tube span 172 of the intermediate tube 112 such that the inner tube 113 is fully contained within the intermediate tube 112 when the telescopic structure 101 is in the collapsed position 103.

The first helical spring 121 is a helix-shaped spring. The first helical spring 121 is formed from a plate instead of a wire. The first helical spring 121 is a compression spring that resists any compressive forces to return to its relaxed shape. The first helical spring 121 is a torsion spring that resists any forces that rotate the first helical spring 121 applied around a center of rotation aligned with the center axis of the first helical spring 121. This resisting force returns the first helical spring 121 to its relaxed shape. The first helical spring 121 attaches to the outer surface of the intermediate tube 112 such that the first helical spring 121 is compressed and rotated when the intermediate tube 112 inserts into the outer tube 111.

The second helical spring 122 is a helix-shaped spring. The second helical spring 122 is formed from a plate instead of a wire. The second helical spring 122 is a compression spring that resists any compressive forces to return to its relaxed shape. The second helical spring 122 is a torsion spring that resists any forces that rotate the second helical spring 122 applied around a center of rotation aligned with the center axis of the second helical spring 122. This resisting force returns the second helical spring 122 to its relaxed shape. The second helical spring 122 attaches to the outer surface of the inner tube 113 such that the second helical spring 122 is compressed and rotated when the inner tube 113 inserts into the intermediate tube 112.

The first detent 131 is a mechanical structure. The first detent 131 attaches the first helical spring 121 to the outer tube 111. The first detent 131 holds the first helical spring 121 is a compressed and rotated position. When the user releases the first detent 131, the first helical spring 121 is released to move towards its relaxed shape.

The second detent 132 is a mechanical structure. The second detent 132 attaches the second helical spring 122 to the first helical spring 121 through the intermediate tube 112. The second detent 132 holds the second helical spring 122 is a compressed and rotated position. When the first helical spring 121 releases the second detent 132, the second helical spring 122 is released to move towards its relaxed shape.

In moving to its relaxed shape, the first helical spring 121 will: a) push the intermediate tube 112 out of the outer tube 111 in the direction away from the proximal end 191; and, b) rotate the intermediate tube 112 around an axis of rotation aligned with the center axis of the intermediate tube 112.

In moving to its relaxed shape, the second helical spring 122 will: a) push the inner tube 113 out of the intermediate tube 112 in the direction away from the proximal end 191; and, b) rotate the inner tube 113 around an axis of rotation aligned with the center axis of the inner tube 113.

In the first potential embodiment of the disclosure, the outer tube 111, the intermediate tube 112, the inner tube 113, the first helical spring 121, and the second helical spring 122 are aligned.

The combustion device 102 is a chemical device. The combustion device 102 is a single-use device. The combustion device 102 is triggered automatically by the extension of the telescopic structure 101 from the collapsed position 103 to the extended position 104. The combustion device 102 generates a flame 181. The flame 181 is a byproduct of the release of energy from a chemical reaction created by the combustion device 102. The chemical reaction of the combustion device 102 is a combustion reaction. The combustion device 102 comprises a first combustible charge 141, a second combustible charge 142, an igniter 143, a striker 144, and a plug 145.

The second combustible charge 142 is packed in the inner tube 113 at a location proximal to the proximal end 191 of the telescopic structure 101. The first combustible charge 141 is packed in the inner tube 113 at a location distal to the proximal end 191 of the telescopic structure 101. The flame 181 generated by the combustion of the first combustible charge 141 and the second combustible charge 142 escapes the inner tube 113 through the distal end 192 of the invention 100.

The first combustible charge 141 is a chemical compound. The first combustible charge 141 is formed from the reactants used to create the combustion reaction during a first phase of the combustion process. The first combustible charge 141 comprises charcoal, potassium perchlorate, and strontium nitrate. The charcoal provides the fuel required by the combustion process. The potassium perchlorate is an oxidizing agent that oxygenates the combustion reaction as it occurs. The strontium nitrate both oxidizes the combustion reaction and give the flame generated by the combustion device 102 a red hue.

The second combustible charge 142 is a chemical compound. The second combustible charge 142 is formed from the reactants used to create the combustion reaction during a second phase of the combustion process. The second combustible charge 142 is ignited by the combustion of the first combustible charge 141. The composition of the second combustible charge 142 is the same as the composition of the first combustible charge 141 with the exception that the second combustible charge 142 further comprises copper (I) chloride. The copper (I) chloride burns with a blue hue such that the flame generated by the combustion device 102 will change from a red hue to a purple hue.

The change in hue caused by the second combustible charge 142 indicates the coming exhaustion of the fuel contained within the combustion device 102.

The igniter 143 and the striker 144 combine to ignite the first combustible charge 141. The igniter 143 mounts on the interior surface of the intermediate tube 112. The striker 144 mounts on the exterior surface and through the surface of the inner tube 113 such that the striker 144 is exposed to the exterior surface of the inner tube 113 while simultaneously being in contact with first combustible charge 141. The igniter 143 is a rough surface formed from a sandpaper type material. The striker 144 is a compound that is sensitive to friction such that the striker 144 ignites when rubbed against the igniter 143.

When the second helical spring 122 is released, the inner tube 113 is simultaneously pushed and rotated out of the intermediate tube 112 such that the striker 144 rubs against the igniter 143 as the inner tube 113 exits the intermediate tube 112. This friction ignites the striker 144 which in turn ignites the first combustible charge 141 to begin the combustion process.

The plug 145 is a sacrificial material that encloses the distal end 192 of the telescopic structure 101. The plug 145 keeps debris from entering the combustion device 102 while the invention 100 is in storage. When the first combustible charge 141, the flame 181 destroys the plug 145 such that the flame 181 exits the telescopic structure 101 through the distal end 192.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Automatic: As used in this disclosure, automatic refers to a device, process, or a system that operates without human control, supervision or participation in the operation of the device, process, or system.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Compression Spring: As used in this disclosure, a compression spring is a wire coil that resists forces attempting to compress the wire coil in the direction of the center axis of the wire coil. The compression spring will return to its original position when the compressive force is removed.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Detent: As used in this disclosure, a detent is a device for positioning and holding a first object relative to a second object such that the position of the first object relative to the second object is adjustable.

Extension Apparatus: As used in this disclosure, an extension apparatus is a mechanical structure that is used to extend the span of the distance between any two objects or the reach of a first object towards a second object.

Extension Structure: As used in this disclosure, an extension structure is an inert physical structure that is used to extend the span of the distance between any two objects.

Handle: As used in this disclosure, a handle is an object by which a tool, object, or door is held or manipulated with the hand.

Helical Spring: As used in this disclosure, a helical spring is a compression spring shaped in the form of a helix such that when the helix spring is compressed the coils of the helix spring slide next to each other.

Helix: As used in this disclosure, a helix is a three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Plug: As used in this disclosure, a plug is an object that is used as a barrier to block access to a cavity or an aperture.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reduction-Oxidation Reaction: As used in this disclosure, a reduction-oxidation reaction (also known as a redox reaction) is a chemical reaction involving the transfer of electrons between the reactants of the reaction.

Relaxed Shape: As used in this disclosure, a structure is considered to be in its relaxed state when no shear, strain, or torsional forces are being applied to the structure.

Sacrificial Material: As used in this disclosure, a sacrificial material is a material that protects a first object or structure from damage. More specifically, the sacrificial material protects the second object or structure by being damaged during use of the second object or structure.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Telescopic: As used in this disclosure, telescopic is an adjective that describes an object made of sections that fit or slide into each other such that the object can be made longer or shorter by adjusting the relative positions of the sections.

Torsion Spring: As used in this disclosure, a torsion spring is a mechanical device that stores mechanical energy through an opposing torque when the mechanical device is twisted. The torsion spring will return to its original relaxed shape when the twisting force is removed.

Tube: As used in this disclosure, the term tube is used to describe a rigid hollow prism. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

With respect to the above description, it is to be realized that the optimum dimensional relationship for the various components of the invention described above and in FIGS. 1 through 2 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A self-defense device comprising a telescopic structure and a combustion device;

wherein the combustion device installs in the telescopic structure;

wherein the combustion device generates a flame;

wherein the telescopic structure is an extendable structure;

wherein the telescopic structure is further defined with a collapsed position, an extended position, a proximal end, and a distal end;

wherein the telescopic structure is stored in the collapsed position;

wherein the telescopic structure: a) automatically extends from the collapsed position to the extended position and, b) ignites the combustion device such that the flame is presented at the distal end of the telescopic structure;

wherein the collapsed position is the position of the telescopic structure that has the minimum span;

wherein the extended position is the position of the telescopic structure that has the maximum span;

wherein a the telescopic structure further comprises a first detent;

wherein the first detent is located at the proximal end;

wherein the telescopic structure is an extension structure; and wherein the release of the first detent automatically: a) extends the telescopic structure from the collapsed position to the extended position; and, b) ignites the combustion device such that the flame is presented at the distal end of the telescopic structure.

2. The self-defense device according to claim 1 wherein the combustion device is a chemical device;

wherein the combustion device is triggered automatically by the extension of the telescopic structure from the collapsed position to the extended position;

wherein the flame is a byproduct of the release of energy from a chemical reaction created by the combustion device;

wherein the chemical reaction of the combustion device is a combustion reaction.

3. The self-defense device according to claim 2 wherein the telescopic structure further comprises an outer tube, an intermediate tube, an inner tube, a first helical spring, a second helical spring, and a second detent;

wherein the inner tube installs in the intermediate tube;

wherein the intermediate tube installs in the outer tube;

wherein the first helical spring attaches to the intermediate tube;

wherein the second helical spring attaches to the inner tube;

wherein the second detent attaches the second helical spring to the first helical spring through the intermediate tube;

wherein the outer tube, the intermediate tube, the inner tube, the first helical spring, and the second helical spring are aligned;

wherein the outer tube is further defined with a first inner diameter, a first outer diameter, and an outer tube span;

wherein the intermediate tube is further defined with a second inner diameter, a second outer diameter, and an intermediate tube span;

wherein the inner tube is further defined with a third inner diameter, a third outer diameter, and an inner tube span.

4. The self-defense device according to claim 3 wherein the combustion device comprises a first combustible charge, a second combustible charge, an igniter, a striker, and a plug;

wherein the second combustible charge is packed in the inner tube at a location proximal to the proximal end of the telescopic structure;

wherein the first combustible charge is packed in the inner tube at a location distal to the proximal end of the telescopic structure;

wherein the flame generated by the combustion of the first combustible charge and the second combustible charge escapes the inner tube through the distal end of the self-defense device.

5. The self-defense device according to claim 4 wherein the outer tube is a capped tube;

wherein the outer tube forms the outer shell of the telescopic structure when the telescopic structure is in a collapsed position;

wherein the capped end of the outer tube forms the proximal end of the telescopic structure;

wherein the outer tube forms the handle of the self-defense device.

6. The self-defense device according to claim 5 wherein the intermediate tube is a capped tube;

wherein the intermediate tube forms an intermediate structure of the telescopic structure between the outer tube and the inner tube;

wherein the intermediate tube is an extension structure that separates the distance between the outer tube and the inner tube when the telescopic structure is in the extended position.

7. The self-defense device according to claim 6 wherein the second outer diameter of the intermediate tube is lesser than the first inner diameter of the outer tube such that the intermediate tube inserts into the intermediate tube in a telescopic fashion.

8. The self-defense device according to claim 7 wherein the intermediate tube span of the intermediate tube is lesser than or equal to the outer tube span of the outer tube such that the intermediate tube is fully contained within the outer tube when the telescopic structure is in the collapsed position.

9. The self-defense device according to claim 8 wherein the inner tube is a capped tube;

wherein the inner tube contains the combustion device;

wherein the open end of the inner tube forms the distal end of the telescopic structure.

10. The self-defense device according to claim 9 wherein the third outer diameter of the inner tube is lesser than the second inner diameter of the intermediate tube such that the inner tube inserts into the intermediate tube in a telescopic fashion.

11. The self-defense device according to claim 10 wherein the inner tube span of the inner tube is lesser than or equal to the intermediate tube span of the intermediate tube such that the inner tube is fully contained within the intermediate tube when the telescopic structure is in the collapsed position.

12. The self-defense device according to claim 11 wherein the first helical spring is a helix-shaped spring;

wherein the first helical spring is formed from a plate;

wherein the first helical spring is a compression spring;

wherein the first helical spring is a torsion spring;

wherein the second helical spring is a helix-shaped spring;

wherein the second helical spring is formed from a plate;

wherein the second helical spring is a compression spring;

wherein the second helical spring is a torsion spring.

13. The self-defense device according to claim 12 wherein the first helical spring attaches to the outer surface of the intermediate tube such that the first helical spring is compressed and rotated when the intermediate tube inserts into the outer tube;

wherein the second helical spring attaches to the outer surface of the inner tube such that the second helical spring is compressed and rotated when the inner tube inserts into the intermediate tube.

14. The self-defense device according to claim 13 wherein the first detent is a mechanical structure;

wherein the first detent attaches the first helical spring to the outer tube;

wherein the first detent holds the first helical spring is a compressed and rotated position;

wherein when the user releases the first detent, the first helical spring is released to move towards its relaxed shape;

wherein the second detent is a mechanical structure;

wherein the second detent attaches the second helical spring to the first helical spring through the intermediate tube;

wherein the second detent holds the second helical spring is a compressed and rotated position;

wherein when the first helical spring releases the second detent, the second helical spring is released to move towards its relaxed shape.

15. The self-defense device according to claim 14 wherein the first helical spring pushes the intermediate tube out of the outer tube in the direction away from the proximal end;

wherein the first helical spring rotate the intermediates tube around an axis of rotation aligned with the center axis of the intermediate tube;

wherein second helical spring pushes the inner tube out of the intermediate tube in the direction away from the proximal end;

wherein second helical spring rotates the inner tube around an axis of rotation aligned with the center axis of the inner tube.

16. The self-defense device according to claim 15 wherein the first combustible charge is a chemical compound;

wherein the first combustible charge is formed from the reactants used to create the combustion reaction during a first phase of the combustion process;

wherein the first combustible charge comprises charcoal, potassium perchlorate, and strontium nitrate;

wherein the second combustible charge is a chemical compound;

wherein the second combustible charge is formed from the reactants used to create the combustion reaction during a second phase of the combustion process;

wherein the second combustible charge is ignited by the combustion of the first combustible charge;

wherein the composition of the second combustible charge is the same as the composition of the first combustible charge and further comprises copper (I) chloride.

17. The self-defense device according to claim 16 wherein the igniter and the striker combine to ignite the first combustible charge;

wherein the igniter mounts on the interior surface of the intermediate tube;

wherein the striker mounts on the exterior surface and through the surface of the inner tube such that the striker is exposed to the exterior surface of the inner tube while simultaneously being in contact with first combustible charge;

wherein when the second helical spring is released, the inner tube is simultaneously pushed and rotated out of the intermediate tube such that the striker rubs against the igniter as the inner tube exits the intermediate tube.

18. The self-defense device according to claim 17 wherein the igniter is a rough surface formed from a sandpaper type material;

wherein the striker is a compound that is sensitive to friction such that the striker ignites when rubbed against the igniter;

wherein this friction ignites the striker which in turn ignites the first combustible charge to begin the combustion process;

wherein the plug is a sacrificial material that encloses the distal end of the telescopic structure;

wherein the plug keeps debris from entering the combustion device while the self-defense device is in storage;

wherein when the flame of the first combustible charge destroys the plug such that the flame exits the telescopic structure through the distal end.

* * * * *